US011271310B2

(12) United States Patent
Kakuya et al.

(10) Patent No.: US 11,271,310 B2
(45) Date of Patent: Mar. 8, 2022

(54) ANTENNA DEVICE

(71) Applicant: DENSO CORPORATION, Kariya (JP)

(72) Inventors: Yuuji Kakuya, Nisshin (JP); Hidenori Akita, Kariya (JP); Masakazu Ikeda, Nisshin (JP); Kenichirou Sanji, Nisshin (JP); Hiroyuki Izumi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/840,484

(22) Filed: Apr. 6, 2020

(65) Prior Publication Data

US 2020/0328516 A1 Oct. 15, 2020

(30) Foreign Application Priority Data

Apr. 10, 2019 (JP) ..... JP2019-075085

(51) Int. Cl.
*H01Q 9/04* (2006.01)
*H01Q 1/48* (2006.01)

(52) U.S. Cl.
CPC ..... *H01Q 9/0407* (2013.01); *H01Q 1/48* (2013.01)

(58) Field of Classification Search
None
See application file for complete search history.

(56) References Cited

U.S. PATENT DOCUMENTS

2008/0258981 A1 10/2008 Achour et al.
2010/0283692 A1 11/2010 Achour et al.
2010/0283705 A1 11/2010 Achour et al.
2012/0268347 A1* 10/2012 Tatarnikov ..... H01Q 9/0407 343/893
2013/0002377 A1 1/2013 Toyao et al.
2014/0097990 A1* 4/2014 Aboush ..... H01Q 21/065 343/700 MS (Continued)

FOREIGN PATENT DOCUMENTS

JP 2014-003670 A 1/2014
JP 2015-142367 A 8/2015

(Continued)

OTHER PUBLICATIONS

Terada et al., "Dual-Band Zeroth-Order Resonant Antenna", Proceedings of the 2017 IEICE Society Conference vol. 1, The Institute of Electronics, Information and Communication Engineers p. 68, Aug. 2017.

*Primary Examiner* — Crystal L Hammond
(74) *Attorney, Agent, or Firm* — Hamess, Dickey & Pierce, P.L.C.

(57) ABSTRACT

An antenna device includes a ground plate that is a conductive member having a plate shape, a patch section that is a conductive member having a plate shape and is disposed in parallel with the ground plate with a predetermined interval so as to face the ground plate, a plurality of first short-circuit vias each having an axial center disposed on a circumference of a via arrangement circle located in a center portion of the patch section and each having a first end connected with the patch section and a second end connected with the ground plate, and at least one second short-circuit via having an axial center disposed at a position different from the circumference of the via arrangement circle and having a first end connected with the patch section and a second end connected with the ground plate.

3 Claims, 5 Drawing Sheets

(56) References Cited

U.S. PATENT DOCUMENTS

| | | | | |
|---|---|---|---|---|
| 2014/0266959 | A1* | 9/2014 | Xue | H01Q 1/38 343/848 |
| 2015/0214630 | A1 | 7/2015 | Shimura | |
| 2017/0215274 | A1* | 7/2017 | Yan | G06F 30/00 |
| 2018/0205151 | A1* | 7/2018 | Celik | H01Q 1/48 |
| 2018/0218182 | A1* | 8/2018 | Sugimoto | G06K 19/07773 |
| 2018/0277946 | A1* | 9/2018 | Murata | H01Q 9/0407 |
| 2019/0103676 | A1 | 4/2019 | Sugimoto et al. | |

FOREIGN PATENT DOCUMENTS

| | | | | |
|---|---|---|---|---|
| JP | 2017-005663 | A | 1/2017 | |
| JP | 2017-152878 | A | 8/2017 | |
| JP | 2019-068176 | A | 4/2019 | |
| WO | WO-2011/114746 | A1 | 9/2011 | |
| WO | WO-2015/049816 | A1 | 4/2015 | |
| WO | WO-2019058378 | A1 * | 3/2019 | H01Q 21/065 |

* cited by examiner

ANTENNA DEVICE

CROSS REFERENCE TO RELATED APPLICATION

The present application claims the benefit of priority from Japanese Patent Application No. 2019-075085 filed on Apr. 10, 2019. The entire disclosure of the above application is incorporated herein by reference.

TECHNICAL FIELD

The present disclosure relates to an antenna device.

BACKGROUND

Conventionally, there has been known an antenna device having a flat plate structure. The antenna device includes a metal conductor having a plate shape and functioning as a ground (hereinafter referred to as a ground plate), a metal conductor having a plate shape, disposed to face the ground plate and provided with a feeding point (hereinafter referred to as a patch section), a short-circuit via for electrically connecting the ground plate and the patch section, and a feeding via for supplying power to the feeding point.

SUMMARY

An antenna device according to an aspect of the present disclosure includes a ground plate, a patch section, a plurality of first short-circuit vias, and at least one second short-circuit via. Each of the first short-circuit vias has an axial center disposed on a circumference of a via arrangement circle positioned at a center portion of the patch section, and has a first end connected with the patch section and a second end connected with the ground plate. The second short-circuit via has an axial center at a position different from the circumference of the via arrangement circle, and has a first end connected with the patch section a second end connected with the ground plate.

BRIEF DESCRIPTION OF DRAWINGS

Objects, features and advantages of the present disclosure will become apparent from the following detailed description made with reference to the accompanying drawings. In the drawings.

DETAILED DESCRIPTION

Figure 1:
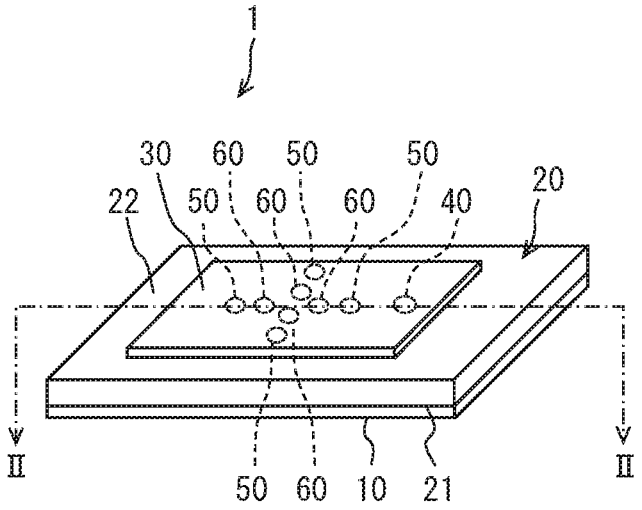
FIG. 1 is a perspective view of an antenna device according to a first embodiment.

In an antenna device including a ground plate, a patch section, a short-circuit via, and a feeding via, parallel resonance is generated due to an electrostatic capacitance formed between the ground plate and the patch section and an inductance included in the short-circuit via. This parallel resonance is generated at a frequency corresponding to the electrostatic capacitance and the inductance. The electrostatic capacitance formed between the ground plate and the patch section is determined according to an area of the patch section and a distance between the ground plate and the patch section.

When manufacturing the antenna device, it may be necessary to form lands at both ends of each of the feeding via and the short-circuit via. Further, a gap is required between the ground plate and the land of the feeding via close to the ground plate so that the land does not come into contact with the ground plate.

The area of the patch section decreases when an operating frequency of the antenna device increases. Therefore, when the operating frequency becomes high, the distance between the land of the feeding via and the land of the short-circuit via may be short. From these facts, when the operating frequency is increased, the land of the feeding via close to the ground plate and the land of the short-circuit via may come into contact with each other, and the manufacture of the antenna device may be difficult.

An antenna device may include a plurality of short-circuit vias arranged on a circumference. When the plurality of short-circuit vias is arranged on the circumference, the plurality of short-circuit vias functions as one cylinder. One short-circuit via is thinner than the cylinder virtually formed by the plurality of short-circuit vias. Therefore, even if a land is required for the short-circuit via, the land becomes small. Therefore, a risk that the land of the short-circuit via and the land of the feeding via come into contact with each other is reduced.

However, in a configuration in which the plurality of short-circuit vias is arranged on one circumference, a current path may be restricted and a band may become narrow.

An antenna device according to an aspect of the present disclosure includes a ground plate, a patch section, a plurality of first short-circuit vias, and at least one second short-circuit via. The ground plate is a conductor member having a plate shape. The patch section is a conductor member having a plate shape and is disposed in parallel with the ground plate with a predetermined interval so as to face the ground plate. Each of the plurality of first short-circuit vias has an axial center disposed on a circumference of a via arrangement circle positioned at a center portion of the patch section, and has a first end connected with the patch section and a second end connected with the ground plate. The second short-circuit via has an axial center at a position different from the circumference of the via arrangement circle, and has a first end connected with the patch section a second end connected with the ground plate.

In the antenna device, when electric current flows through the plurality of first short-circuit vias, the plurality of first short-circuit vias operates as one columnar short-circuit via having a radius of the via arrangement circle. An LC parallel resonance circuit is formed in the antenna device, and the LC parallel resonance circuit is determined by the inductance of the columnar short-circuit via and the capacitance between a portion of the patch section outside the columnar short-circuit via and the ground plate. Therefore, the antenna device operates at a frequency at which the LC parallel resonance circuit resonates.

However, the antenna device includes the second short-circuit via. The second short-circuit via is also connected to the patch section and the ground plate in a manner similar to the first short-circuit vias. Therefore, when electric current flows through the first short-circuit vias, electric current also flows through the second short-circuit via. The fact that the electric current flows through the second short-circuit via means that the number of current paths through which the electric current flows from the patch section to the ground plate is increased as compared with a case where only the first short-circuit vias are provided. The resonance frequency is slightly different for each current path. Therefore, the operating frequency of the antenna device becomes broader due to increase of the number of the current paths.

First Embodiment

Hereinafter, embodiments will be described with reference to the drawings. FIG. 1 is a perspective view of an antenna device 1 according to a first embodiment. The antenna device 1 is used, for example, in a vehicle and is mounted on a roof of the vehicle. The antenna device 1 performs one or both of transmission and reception of radio waves. The antenna device 1 is connected to, for example, a wireless device through a coaxial cable (both are not shown), and signals received by the antenna device 1 are sequentially output to the wireless device.

The antenna device 1 converts an electric signal input from the wireless device into a radio wave and emits the radio wave into space. The wireless device uses signals received by the antenna device 1, and also supplies high-frequency power corresponding to transmission signals to the antenna device 1. As a power supply line to the antenna device 1, another power supply line such as a feeder line may be used instead of the coaxial cable.

Hereinafter, a specific structure of the antenna device 1 will be described. The antenna device 1 includes a ground plate 10 having a flat plate shape. The ground plate 10 is a conductive member such as copper. The ground plate 10 is electrically connected to an external conductor of the coaxial cable and forms a ground potential in the antenna device 1. The plate shape of the ground plate 10 includes a thin film shape such as a foil. That is, the ground plate 10 may be a pattern formed on a surface of a resin plate such as a printed wiring board.

The ground plate 10 is attached to a rear surface 21 of a support plate 20. The support plate 20 is made of an insulating material such as a glass epoxy resin. The support plate 20 is a member that plays a role in arranging the ground plate 10 and the patch section 30 so that plane portions of the ground plate 10 and the patch section 30 face each other at a predetermined interval. The support plate 20 has a rectangular plate shape, and a size of the support plate 20 is substantially the same as a size of the ground plate 10 in plan view. However, the size of the ground plate 10 may be any size equal to or larger than the patch section 30.

Further, the shape of the ground plate 10 as viewed from above (hereinafter, a planar shape) may be appropriately designed. Note that an upper direction in the present disclosure is a direction in which the patch section 30 is provided on the ground plate 10. In the antenna device 1 shown in FIG. 1, the planar shape of the ground plate 10 is rectangular. However, in another embodiment, the planar shape of the ground plate 10 may be a square whose center position in the planar direction is the same as a center position of the patch section 30. The planar shape of the ground plate 10 may be another polygonal shape such as a hexagon. The planar shape of the ground plate 10 may be circular. Of course, the ground plate 10 may also have a shape formed of a combination of straights portion and curved portions.

The shape of the support plate 20 is not limited to a plate shape, as long as the support plate 20 fulfills the above-described role. For example, the support plate 20 may be a plurality of posts that support the ground plate 10 and the patch section 30 so as to face each other with the predetermined interval. Further, in the present embodiment, the gap between the ground plate 10 and the patch section 30 is filled with resin (i.e., the support plate 20), but the present embodiment is not limited to this configuration. Instead, the gap between the ground plate 10 and the patch section 30 may be hollow or a vacuum, or may be filled with a dielectric having a particular dielectric ratio. In addition, the structures exemplified above may be combined. When the antenna device 1 is realized using a printed wiring board, a plurality of conductor layers included in the printed wiring board may be used as the ground plate 10 and the patch section 30 and a resin layer separating the conductor layers may be used as the support plate 20.

The patch section 30 is disposed on a front surface 22 of the support plate 20. The patch section 30 faces the ground plate 10 with the support plate 20 interposed therebetween. The patch section 30 is parallel to the ground plate 10 via the support plate 20. The term "parallel" here is not limited to perfect parallel. The patch section 30 may be inclined from several degrees to about ten degrees with respect to the ground plate 10. That is, the term "parallel" includes a substantially parallel state.

The patch section 30 according to the present embodiment has a square shape. However, the shape of the patch section 30 may be a rotationally symmetric plan figure other than a square (for example, a circle or a regular hexagon). Further, the patch section 30 may have a shape symmetrical with respect to two straight lines passing through a center of the patch section 30 and orthogonal to each other (for example, a rectangle). In addition, the shape of the patch section 30 may be a shape having no particular symmetry. An edge portion of the patch section 30 may be partially or entirely formed in a meander shape. Further, the patch section 30 may be provided with a notch at the edge portion or a corner portion of the patch section 30 may be rounded. The size of the patch section 30 is equal to or smaller than the size of the ground plate 10.

The patch section 30 is a conductive member such as copper and has a plate shape. The plate shape of the patch section 30 includes a thin film shape such as a foil. That is, the patch section 30 may be formed by forming a conductor pattern on a surface of a resin plate such as a printed wiring board.

The patch section 30 and the ground plate 10 are disposed to face each other to form an electrostatic capacity according to an area of the patch section 30 and the distance between the patch section 30 and the ground plate 10. The area of the patch section 30 may be appropriately designed according to the size required for the antenna device 1.

Figure 2:
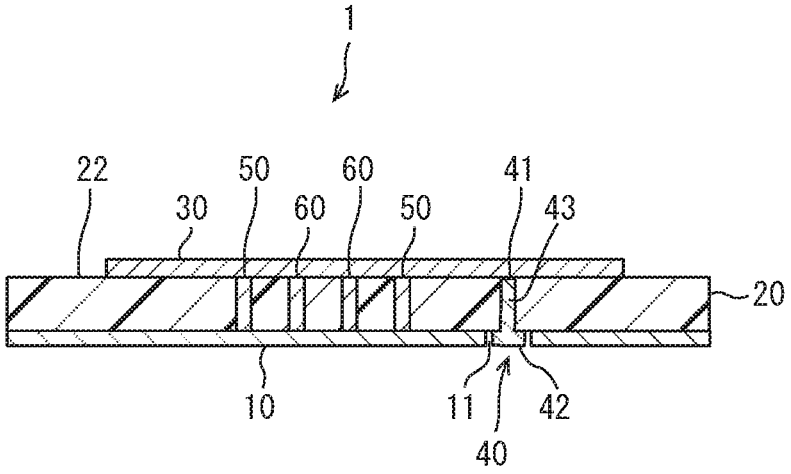
FIG. 2 is a cross-sectional view of the antenna device taken along line II-II of FIG. 1.

FIG. 2 is a cross-sectional view taken along the line II-II of FIG. 1. As shown in FIGS. 1 and 2, the antenna device 1 includes a feeding via 40, first short-circuit vias 50, and second short-circuit vias 60. Each of the feeding via 40, the first short-circuit vias 50, and the second short-circuit vias 60 is made of a conductive material such as copper.

The feeding via 40 has a feeding point 41 at a first end close to the patch section 30, and the feeding point 41 is in contact with the patch section 30. The feeding via 40 further has a second end opposite to the first end and is connected with the coaxial cable. Therefore, the feeding via 40 electrically connects the patch section 30 and the coaxial cable. Each of the first short-circuit vias 50 and the second short-circuit vias 60 has a first end connected with the patch section 30 and a second end connected with the ground plate 10. Therefore, the first short-circuit vias 50 and the second short-circuit vias 60 electrically connect the patch section 30 and the ground plate 10.

Each of the feeding via 40, the first short-circuit vias 50, and the second short-circuit vias 60 has an axial center perpendicular to the ground plate 10 and the patch section 30 that have plate shapes. Further, each of feeding via 40, the first short-circuit vias 50, and the second short-circuit vias 60 is a conductor member having a relatively small diameter with respect to a length in a height direction, that is, a thin round column shape. However, each of feeding via 40, the first short-circuit vias 50, and the second short-circuit vias 60 needs not have the round column shape, but may have a prismatic column shape or a column shape whose cross section is a semicircular or a fan-shaped.

FIG. 2 shows a land 42 formed at the second end of feeding via 40 close to the ground plate 10. The feeding via 40 includes a main body 43 and the land 42. The main body 43 has a round column shape. The land 42 extends radially from an end of the main body 43. The land 42 is a part that needs to be formed when the main body 43 is formed in manufacturing.

The feeding via 40 is connected with the coaxial cable that supplies power to the patch section 30. On the other hand, the ground plate 10 is a part for forming the ground potential. Therefore, the ground plate 10 is provided with a hole for accommodating the land 42 and a periphery of the land 42, and a gap 11 is provided between the ground plate 10 and the land 42. Further, it can be seen that the feeding via 40 penetrates through the ground plate 10.

Figure 3:
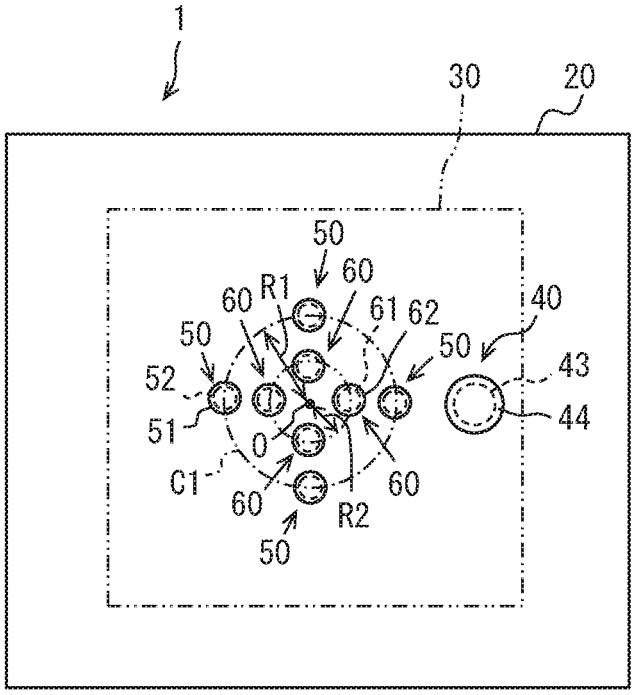
FIG. 3 is a plan view of the antenna device from which a patch section is removed.

For convenience of illustration, FIG. 2 does not show lands at the first end of the feeding via 40 provided with the feeding point 41 and at both ends of the first short-circuit vias 50 and the second short-circuit vias 60. However, lands are also formed at these ends, FIG. 3 is a plan view of the antenna device 1 from which the patch section 30 is removed. As shown in FIG. 3, the feeding via 40 further has a land 44 formed at the first end close to the patch section 30. Each of the first short-circuit vias 50 has a land 51 at the first end close to the patch section 30. Each of the first short-circuit vias 50 further has a main body 52 having a round column shape, and the land 51 is formed at an end of the main body 52 close to the patch section 30, and extends from the main body 52 radially outward. For convenience of illustration, only one of the first short-circuit vias 50 is assigned with reference numerals of the land 51 and the main body 52.

Further, each of the second short-circuit vias 60 has a land 61 at the first end close to the patch section 30. Each of the second short-circuit vias 60 further has a main body 62 having a round column shape, and the land 61 is formed at an end of the main body 62 close to the patch section 30, and extends from the main body 62 radially outward. For convenience of illustration, only one of the second short-circuit vias 60 is assigned with reference numerals of the land 61 and the main body 62.

The land 44 of the feeding via 40 at which the feeding point 41 is provided is in contact with the patch section 30. In addition, the lands 51 and 61 of the first short-circuit vias 50 and the second short-circuit vias 60 formed close to the patch section 30 are electrically connected with the patch section 30. The lands of the first short-circuit vias 50 and the second short-circuit vias 60 formed close to the ground plate 10 are electrically connected with the ground plate 10.

The antenna device 1 includes the plurality of first short-circuit vias 50. Specifically, the antenna device 1 includes four first short-circuit vias 50. Note that the number of the first short-circuit vias 50 is an example. The first short-circuit vias 50 are arranged such that the axial center of each of the first short-circuit vias 50 is located on the circumference of a circle (hereinafter, referred to as a via arrangement circle C1) having a radius R1 and centered on a patch center point O which is the center of the patch section 30. The patch center point O is the center of gravity of the patch section 30. The first short-circuit vias 50 are arranged at equal intervals on the circumference of the via arrangement circle C1.

The second short-circuit vias 60 are arranged such that the axial center of each of the second short-circuit vias 60 is located on a circumference of a circle having a radius R2 smaller than the radius R1 and centered on the patch center point O. The circle having the radius R2 is an inner circle located closer to the center of the patch section 30 than the via arrangement circle C1. The antenna device 1 also includes the plurality of second short-circuit vias 60. Specifically, the antenna device 1 includes four second short-circuit vias 60. Note that the number of the second short-circuit vias 60 is an example. The number of the second short-circuit vias 60 may be one or more.

The arrangement position of the feeding via 40 in the present embodiment is in the vicinity of the middle between the via arrangement circle C1 and one side of the patch section 30. In the present embodiment, the diameter of the feeding via 40 is larger than the diameter of each of the first short-circuit vias 50 and the diameter of each of the second short-circuit vias 60. However, these diameters can be variously changed.

The operation of the antenna device 1 configured as described above will be described. The operation of the antenna device 1 when transmitting radio waves and the operation of the antenna device 1 when receiving radio waves are mutually reversible. Therefore, as an example, the operation of transmitting radio waves will be described, and descriptions of receiving radio waves will be omitted.

Each of the first short-circuit vias 50 provides an inductance corresponding to the length in the height direction and the diameter (p1 of each of the first short-circuit vias 50. When the diameter (p1 of each of the first short-circuit vias 50 increases, the value of the inductance provided by each of the first short-circuit vias 50 decreases.

The plurality of first short-circuit vias 50 arranged on the circumference of the via arrangement circle C1 behave as one columnar short-circuit via having a radius R1. According to another viewpoint, the first short-circuit vias 50 correspond to one columnar conductor that connects a central region of the patch section 30 and the ground plate 10. For convenience, the inductance provided by the plurality of first short-circuit vias 50 acting as one columnar conductor is referred to as an equivalent inductance Le.

The equivalent inductance Le is mainly determined by the radius R1 among the radius R1, the number of the first short-circuit vias 50, and the diameter (p1 of each of the first short-circuit vias 50. When the radius R1 increases, the first short-circuit vias 50 behave as a columnar conductor having a larger diameter, That is, when the radius R1 increases, the equivalent inductance Le decreases.

The radius R1 is set such that, at the operating frequency f of the antenna device 1, the equivalent inductance Le becomes a value that resonates in parallel with the capacitance provided by the patch section 30. The adjustment of the equivalent inductance Le is mainly realized by adjusting the radius R1. However, additionally, the equivalent inductance Le can be adjusted according to the number of the first short-circuit vias 50 and the diameter of each of the first short-circuit vias 50.

At the operating frequency of the antenna device 1, electric current flows from the patch section 30 to the ground plate 10 through the first short-circuit vias 50. At this time, the plurality of first short-circuit vias 50 arranged on the circumference of the via arrangement circle C1 behave integrally as the columnar short-circuit via having the radius R1 as described above, Therefore, the electric current mainly flows on a side surface (in other words, a columnar surface) of the columnar short-circuit via having the radius R1. At this time, since a small amount of electric current flows through the inside of the via arrangement circle C1 in the patch section 30, a portion between a portion of the patch section 30 outside the via arrangement circle C1 and the ground plate 10 contributes to the formation of capacitance. An LC parallel resonance circuit determined by the capacitance and the equivalent inductance Le is formed in the antenna device 1. The operating frequency of the antenna device 1 is determined by the frequency at which the LC parallel resonance circuit resonates.

However, the antenna device 1 also includes the second short-circuit vias 60 in addition to the first short-circuit vias 50. Since the second short-circuit vias 60 are provided, there are also current paths that flow from the patch section 30 to the ground plate 10 through the second short-circuit vias 60.

That is, in the antenna device 1, current paths flowing from the patch section 30 to the ground plate 10 include the current paths through the second short-circuit vias 60 in addition to the current paths through the first short-circuit vias 50. The resonance frequency is slightly different for each current path. Therefore, the antenna device 1 resonates at a higher resonance frequency than in a case where the second short-circuit vias 60 are not provided. This means that the operating frequency band of the antenna device 1 can be wider than in the case where the second short-circuit vias 60 are not provided. As described above, since the operating frequency band can be widened by providing the second short-circuit vias 60, the number and positions of the second short-circuit vias 60 are appropriately set according to the operating frequency and the bandwidth.

In the antenna device 1, the first short-circuit vias 50 are arranged at equal intervals on the circumference of the via arrangement circle C1, and the second short-circuit vias 60 are also arranged at equal intervals on the circumference of the radius R2. With this configuration, the antenna device 1 can emit vertically polarized waves in a wide frequency band with almost the same gain in all directions in the 360-degree direction on a plane including the ground plate 10 and the patch section 30.

In the antenna device 1, the feeding via 40 penetrates the ground plate 10, and the first end of the feeding via 40 is connected to the patch section 30 at the feeding point 41. The coaxial cable is connected to the second end of the feeding via 40 close to the ground plate 10. Therefore, the coaxial cable extends below the antenna device 1. In such a configuration, the plurality of antenna devices 1 is more easily arranged in the direction along the plate than when the coaxial cable extends from the flat antenna device 1 in the direction along the plate.

Second Embodiment

Next, a second embodiment will be described. In the description of the second and subsequent embodiments, elements having the same reference numerals as those used so far are identical to the elements having the same reference numerals in the previous embodiment(s), unless otherwise specified. When only a part of the configuration is described, the embodiment described above can be applied to other parts of the configuration.

Figure 4:
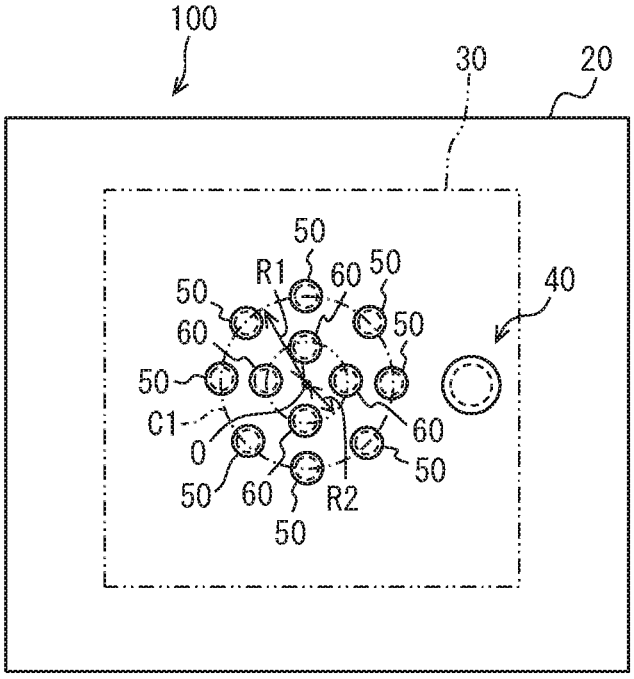
FIG. 4 is a diagram showing an antenna device according to a second embodiment.

FIG. 4 is a diagram showing an antenna device 100 according to a second embodiment. FIG. 4 is a diagram corresponding to FIG. 3 of the first embodiment. That is, FIG. 4 is a plan view of the antenna device 100 excluding the patch section 30. The antenna device 100 is different from antenna device 1 only in the number of first short-circuit vias 50.

In the antenna device 100, eight first short-circuit vias 50 are arranged on the circumference of the via arrangement circle C1. The eight first short-circuit vias 50 are arranged at equal intervals. The number of the second short-circuit vias 60 in the antenna device 100 is the same as the number of the second short-circuit vias 60 in the antenna device 1 of the first embodiment. In this way, the number of the first short-circuit vias 50 and the number of the second short-circuit vias 60 may be different, such as the number of the first short-circuit vias 50 is greater than the number of the second short-circuit vias 60.

Figure 5:
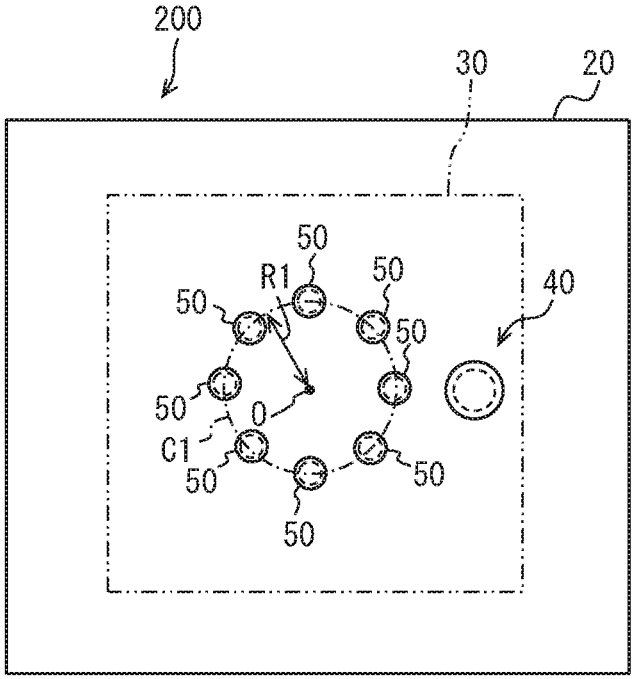
FIG. 5 is a diagram showing an antenna device according a comparative example.

FIG. 5 shows an antenna device 200 according to a comparative example. The antenna device 200 according to the comparative example has a configuration in which all the second short-circuit vias 60 are removed from the antenna device 100 according to the second embodiment.

Figure 6:
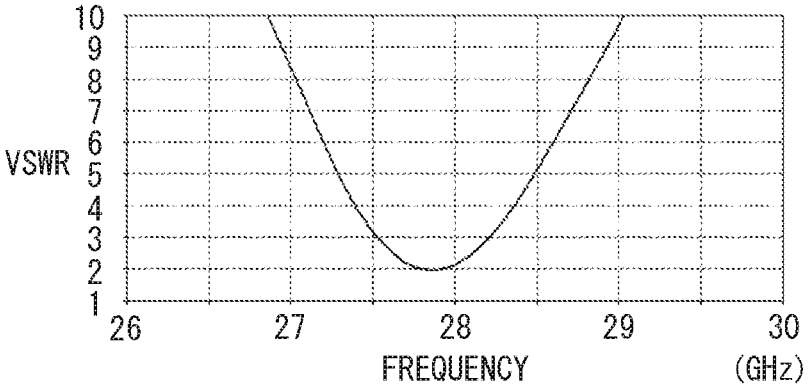
FIG. 6 is a diagram showing a relationship between a VSWR and a frequency of the antenna device according to the second embodiment.
Figure 7:
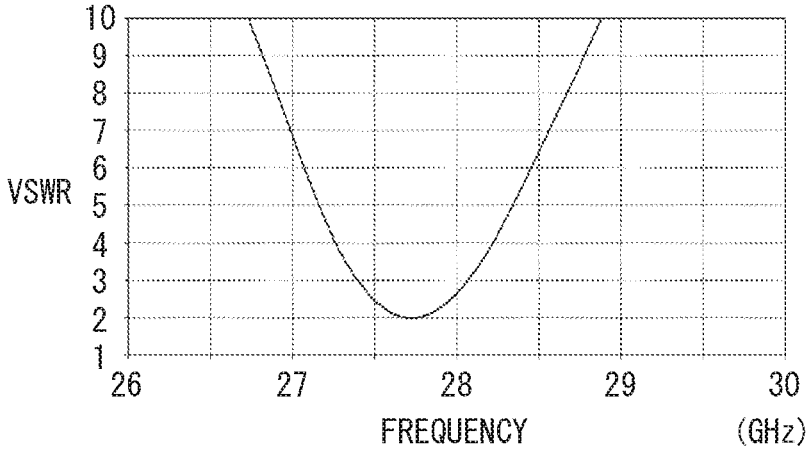
FIG. 7 is a diagram showing a relationship between a VSWR and a frequency of the antenna device according to the comparative example.

FIG. 6 shows a relationship between a voltage standing wave ratio (hereinafter, referred to as VSWR) and a frequency of the antenna device 100 according to the second embodiment. FIG. 7 shows a relationship between a VSWR and a frequency of the antenna device 200 according to the comparative example. The relationships shown in FIGS. 6 and 7 are obtained by simulation.

As shown in the frequency axes of FIGS. 6 and 7, operating frequencies of the antenna devices 100 and 200 are in the 28 GHz band which is one of frequency bands allocated to a fifth generation mobile phone communication system. However, the operating frequency bands of the antenna devices 1, 100, 200 are not limited to this frequency band. There is no particular limitation on the operating frequency bands, such as the 3.7 GHz band, the 4.5 GHz band, and the 1.58 GHz band.

As can be seen from the comparison between FIGS. 6 and 7, the operating frequency band of the antenna device 100 according to the second embodiment, which includes the second short-circuit vias 60, is wider than the operating frequency band of the antenna device 200 according to the comparative example. Specifically, the bandwidth of the antenna device 100 according to the second embodiment is 689 MHz, whereas the bandwidth of the operating frequency of the antenna device 200 according to the comparative example is 661 MHz.

Third Embodiment

Figure 8:
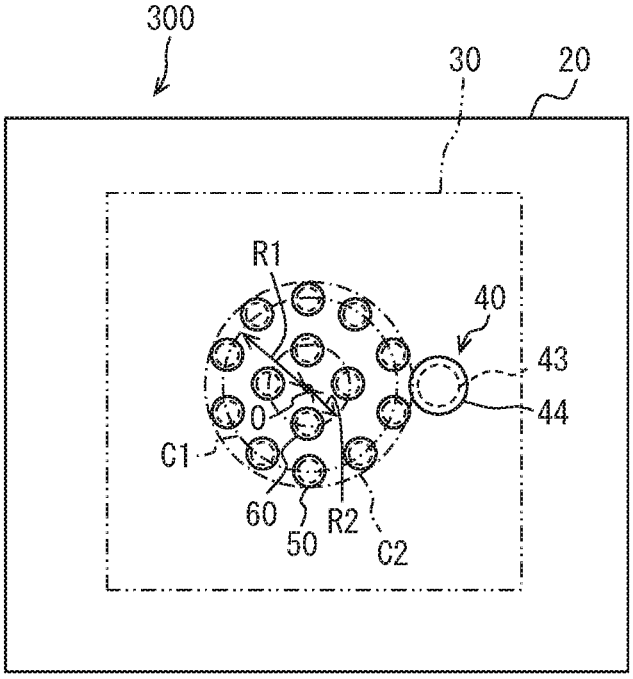
FIG. 8 is a diagram showing an antenna device according to a third embodiment.

FIG. 8 is a diagram showing an antenna device 300 according to a third embodiment. FIG. 8 is a diagram corresponding to FIG. 3 of the first embodiment. That is, FIG. 8 is a plan view of the antenna device 300 excluding the patch section 30. The antenna device 300 is different from the antenna device 1 in the number of the first short-circuit vias 50 and the position of the feeding via 40.

The antenna device 300 according to the third embodiment includes ten first short-circuit vias 50. The position of the feeding via 40 is closer to the patch center point O than the position of the feeding via 40 in the first embodiment.

More specifically, in the antenna device 300, the feeding via 40 is positioned such that the land 44 of the feeding via 40 is located closer to the patch center point O than the circumference of the circle C2, The circle C2 is a circle inside which the plurality of first short-circuit vias 50 is located and with which each of the first short-circuit vias 50 is in contact.

When one short-circuit via having a radius R1 is provided, the land of the one short-circuit via and the land of the feeding via 40 interfere with each other at the position of the feeding via 40 according to the third embodiment. However, in a configuration in which the plurality of first short-circuit vias 50 is arranged on the circumference of the via arrangement circle C1 having the radius R1, as shown in FIG. 8, the first short-circuit vias 50 and the feeding via 40 can be arranged so as not to interfere with each other.

Although the embodiments of the present disclosure have been described above, the present disclosure is not limited to the above embodiments, and various modified examples described below are also included in the technical scope of the present disclosure. Furthermore, various modifications other than the following can be made without departing from the gist.

(First Modification)

Figure 9:
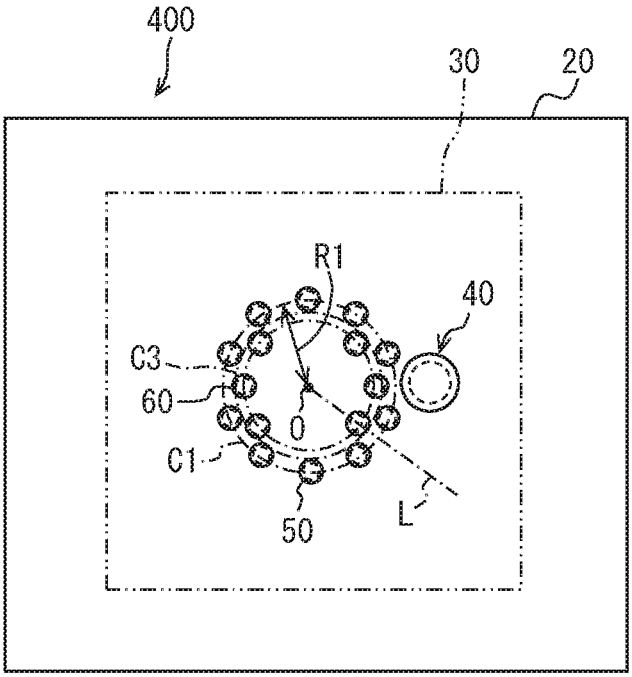
FIG. 9 is a diagram showing an antenna device according to a modification.

In an antenna device 400 according to a first modification shown in FIG. 9, the second short-circuit vias 60 are arranged at positions closer to the via arrangement circle C1 with respect to the antenna device 300 according to the third embodiment. Specifically, in the antenna device 400, the second short-circuit vias 60 are located closer to an end of the patch section 30 than a circumference of a circle C3. The circle C3 is a circle outside which the plurality of first short-circuit vias 50 is located and with which each of the first short-circuit vias 50 is in contact.

In the antenna device 400, a line segment L passing from the patch center point O to the center of each of the second short-circuit vias 60 does not intersect with the first short-circuit vias 50 on a plane parallel to the patch section 30 or the ground plate 10. When the second short-circuit vias 60 are arranged as described above, the position of the second short-circuit vias 60 can be set to positions close to the via arrangement circle C1.

Further, in the antenna device 400, the intervals of the second short-circuit vias 60 are partially not equal. In this way, the second short-circuit vias 60 may be arranged at intervals other than equal intervals.

(Second Modification)

In the above-described embodiments, the center of the via arrangement circle C1 on which the first short-circuit vias 50 are arranged is the patch center point O. However, the center of the via arrangement circle C1 may not be the patch center point O. For example, the center of the via arrangement circle C1 may be in the center portion of the patch section 30 other than the patch center point O. Here, the center portion means a range in which a bias of directivity caused by the center of the via arrangement circle C1 deviating from the patch center point O falls within a predetermined allowable range.

(Third Modification)

In the above-described embodiments, the via arrangement circle C1 is a perfect circle. However, the via arrangement circle C1 may be an ellipse as long as a bias of directivity falls within an allowable level. That is, the circular shape includes the elliptical shape.

(Fourth Modification)

The second short-circuit vias 60 may be located outside the via arrangement circle C1.

What is claimed is:

1. An antenna device comprising:

a ground plate that is a conductive member having a plate shape;

a patch section that is a conductive member having a plate shape and is disposed in parallel with the ground plate with a predetermined interval so as to face the ground plate;

a plurality of first short-circuit vias each having an axial center disposed on a circumference of a via arrangement circle located in a center portion of the patch section, and each having a first end connected with the patch section and a second end connected with the ground plate; and at least one second short-circuit via having an axial center disposed at a position different from the circumference of the via arrangement circle, and having a first end connected with the patch section and a second end connected with the ground plate.

2. The antenna device according to claim 1, wherein the at least one second short-circuit via includes a plurality of second short-circuit vias, and each of the plurality of second short-circuit vias has the axial center disposed on a circumference of an inner circle that is located closer to a center of the patch section than the via arrangement circle.

3. The antenna device according to claim 1, further comprising a feeding via penetrating through the ground plate, having a first end connected with the patch section and a second end close to the ground plate, and having lands formed at the first end and the second end of the feeding via, wherein a gap is provided between the ground plate and the land formed at the second end of the feeding via.

* * * * *